US009408507B2

(12) United States Patent
Brannan, Jr.

(10) Patent No.: US 9,408,507 B2
(45) Date of Patent: Aug. 9, 2016

(54) PAPER SHEET MATERIAL DISPENSER APPARATUS WITH DYNAMIC BRAKING

(71) Applicant: DISPENSING DYNAMICS INTERNATIONAL, City of Industry, CA (US)

(72) Inventor: Richard Dale Brannan, Jr., Hacienda Heights, CA (US)

(73) Assignee: Dispensing Dynamics International, City of Industry, CA (US)

( * ) Notice: Subject to any disclaimer, the term of this patent is extended or adjusted under 35 U.S.C. 154(b) by 167 days.

(21) Appl. No.: 14/283,327

(22) Filed: May 21, 2014

(65) Prior Publication Data

US 2015/0335212 A1 Nov. 26, 2015

(51) Int. Cl.

| | |
|---|---|
| ***B65H 20/02*** | (2006.01) |
| ***A47K 10/38*** | (2006.01) |
| *A47K 10/36* | (2006.01) |

(52) U.S. Cl.

CPC ..... *A47K 10/38* (2013.01); *A47K 10/3625* (2013.01); *A47K 2010/3668* (2013.01); *A47K 2010/3675* (2013.01); *A47K 2010/3863* (2013.01)

(58) Field of Classification Search

CPC ..... A47K 10/00; A47K 10/16; A47K 10/18; A47K 10/22; A47K 10/24; A47K 10/26; A47K 10/32; A47K 10/34; A47K 10/36; A47K 10/3606; A47K 2010/3675

USPC ..... 242/564, 564.1, 564.3, 564.4, 564.5, 242/565, 563, 563.1, 563.2

See application file for complete search history.

(56) References Cited

U.S. PATENT DOCUMENTS

| | | | | |
|---|---|---|---|---|
| 3,730,409 | A | 5/1973 | Ratti | |
| 5,452,832 | A * | 9/1995 | Niada | A47K 10/36 225/10 |
| 6,820,785 | B2 | 11/2004 | Kapiloff | |
| 6,994,408 | B1 * | 2/2006 | Bunnell | A47K 10/36 312/34.8 |
| 7,887,005 | B2 * | 2/2011 | Troutman | A47K 10/36 242/419.5 |
| 7,984,872 | B2 * | 7/2011 | Kuehneman | A47K 10/36 242/390.9 |
| 8,382,026 | B2 | 2/2013 | Keily et al. | |
| 8,555,761 | B2 | 10/2013 | Keily et al. | |
| 8,632,030 | B2 * | 1/2014 | Troutman | A47K 10/36 242/563.2 |
| 2003/0110911 | A1 * | 6/2003 | Kapiloff | A47K 10/36 83/208 |

FOREIGN PATENT DOCUMENTS

| | | |
|---|---|---|
| WO | WO0063100 | 10/2000 |

* cited by examiner

*Primary Examiner* — William A Rivera
(74) *Attorney, Agent, or Firm* — Thomas R. Lampe

(57) ABSTRACT

A paper sheet material dispenser operated by a DC motor has dynamic braking structure electrically braking the motor to provide more accurate positioning of the paper sheet material tail portion leading end when DC power to the DC motor is terminated.

5 Claims, 6 Drawing Sheets

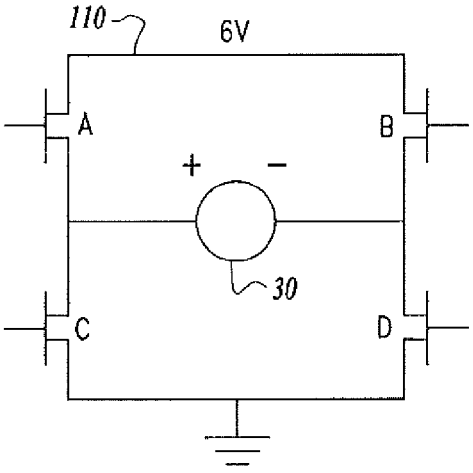
*Fig. 21*
Transistor ON/OFF Matrix
| | A | B | C | D |
|---|---|---|---|---|
| Motor On | ON | OFF | OFF | ON |
| Motor Braking | OFF | OFF | ON | ON |
Transistor ON equivalent to "Closed", allows current to flow
Transistor OFF equivalent to "Open", no current flows through
*Fig. 22*
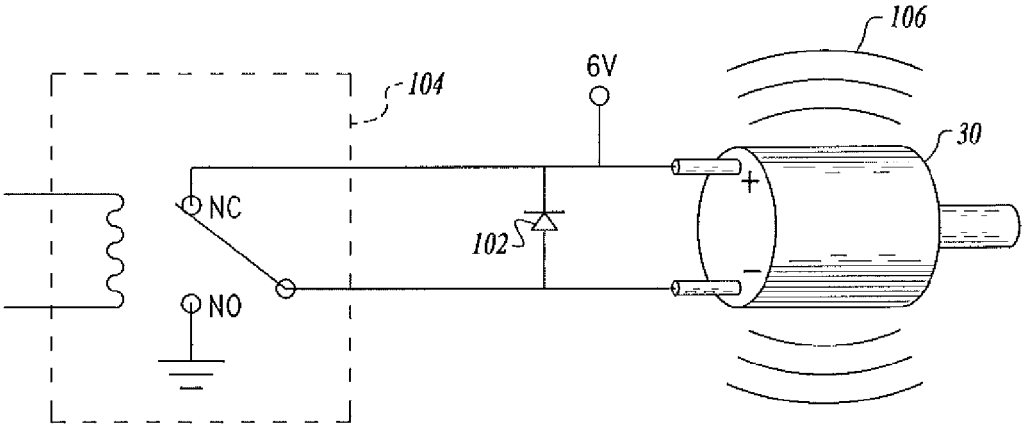
*Fig. 23*

PAPER SHEET MATERIAL DISPENSER APPARATUS WITH DYNAMIC BRAKING

TECHNICAL FIELD

This invention relates to apparatus operable to dispense paper toweling or other paper sheet material from a roll. More particularly, the invention relates to paper sheet material dispensers employing electric motors to advance the sheet material during the dispensing operation.

BACKGROUND OF THE INVENTION

Electro-mechanical dispensers employing an electric motor to transport toweling during a dispensing operation are well known. Such arrangements include both dispensers which are manually actuated, as by means of a push button, and those employing a sensor, such as a sensor sensing proximity of a user's hand, to initiate operation.

U.S. Pat. No. 6,820,785 issued Nov. 23, 2004, discloses an electro-mechanical roll towel dispenser including a housing with a roll carrier disposed therein to rotatably support a roll of towel material. An electro-mechanical feed mechanism is disposed in the housing to dispense measured sheets of the towel material. The feed mechanism operates in a first mechanical operational mode wherein the towel sheets are dispensed by a user grasping and pulling on a tail of the towel material extending from the housing, and a second electrical operational mode wherein a measured length of a next sheet is automatically fed from the housing to define the tail for the next user.

The dispenser of U.S. Pat. No. 6,820,785 includes a sensor for detecting a parameter that is changed by an initial pull exerted on a tail of a web of material extending from the opening of the dispenser. The sensor also generates a signal sent from the sensor to a control circuit or circuitry causing the motor employed in the apparatus to drive the feed mechanism until a measured length of web material that includes the tail of web material has been fed from the dispenser in the form of a measured sheet for subsequent removal by the user.

Similar devices are disclosed in U.S. Pat. No. 3,730,409 and Patent Publication Document WO 00/63100. The devices of these latter two documents have sensors for detecting movement of a tail end of web material such that the feed mechanism is activated in response to detecting the movement.

U.S. Pat. No. 8,382,026, issued Feb. 23, 2013, relates to a multi-function paper towel dispenser selectively operable to dispense paper toweling from a roll of paper toweling employing a plurality of alternative operational modes. The desired mode of operation can be selected utilizing control switches associated with sensor structure and electronic control circuitry of the dispenser. The multi-function paper towel dispenser is characterized not only by its versatility, but by its relative simplicity, ease of use and reliability in any of the operational modes selected. Two of the modes are a paper hidden mode and a paper exposed mode, each of which utilizes sensor structure in combination with electronic control circuitry to operate an electric motor driven rotatable toweling support roller to partially cut and dispense the paper toweling. The electric motor is also utilized to rotate the paper toweling support roller when not employing the sensor structure, the motor essentially operating in a hybrid mode wherein a pull force exerted on the toweling tail initiates rotation of the toweling support roller, the electric motor then being energized to reduce the pull force required by a user to effect final dispensing of a towel. Furthermore, a user can manually rotate the paper toweling support roller to effect dispensing of a towel in any of the modes.

The sensor structure of the multi-function paper towel dispenser is operatively associated with the electric motor to energize the electric motor and cause rotation of the toweling support roller to transport the paper toweling for dispensing from the dispenser in either a first mode of operation wherein the electric motor is energized responsive to the sensor structure sensing positioning of a user's hand at a predetermined location external of the housing or in a second mode of operation wherein the electric motor is energized responsive to the sensor structure sensing the removal of a toweling tail from a location external of the housing.

U.S. Pat. No. 8,555,761 discloses another type of "hybrid" mode wherein an electric motor provides a tail if needed. The term "hybrid" encompasses either motor assist type, which could be used in one dispenser, if desired, using a selector switch.

A common feature of electro-mechanical paper toweling material dispensers is an electric motor which is operatively associated with a rotatable paper sheet support roller and which starts and stops to deliver the leading end of the toweling to a desired position (which may be either within the dispenser housing in certain types of dispenser operations or outside the dispenser housing in other types of dispenser operations).

It is important to provide consistent length of the towel portion to be dispensed and thus uniform placement of the leading end of the towel portion. This is true regardless of cutter blade type employed in a dispenser, whether fixed or toweling support roller mounted. Consistent towel portion length is especially useful in certain dispenser types allowing a motor assist mode wherein an overrun can trigger a second sheet to dispense.

As will be described below, the present invention utilizes dynamic braking in a unique combination with certain other paper sheet material dispenser apparatus components. While dynamic braking structures are known, use of such structures with paper sheet dispenser apparatus as disclosed herein is novel.

DISCLOSURE OF INVENTION

With the invention disclosed herein the tail remains consistent whether the batteries powering the DC motor employed have full voltage or are drained.

The tail also remains consistent as the roll diameter is consumed from a full roll (large diameter) to consumed roll (small diameter).

Another advantage is that a manufacturer can have a larger manufacturing tolerance for its mechanisms. That is, tail length consistency is less affected by tight or loose mechanisms.

The present invention relates to paper sheet material dispenser apparatus for dispensing paper sheet material from a roll of paper sheet material having an existing tail portion with a leading end.

The apparatus includes a housing having a housing interior and defining an opening communicating with said housing interior.

A roll support is within said housing interior for rotatably supporting the roll of paper sheet material, the sheet material support roller having a cylindrically-shaped outer peripheral surface.

The apparatus also includes a DC motor for receiving DC power from a DC power source, the DC motor operatively associated with the sheet material support roller for rotating the sheet material support roller to move the tail portion relative to the opening to a preselected position with the leading end thereof disposed either within the housing interior or externally of the housing.

Dynamic braking structure is operatively associated with the DC motor responsive to termination of DC power from the DC power source to the DC motor to brake the DC motor and place the tail portion at said preselected position.

Other features, advantages and objects of the present invention will become apparent with reference to the following description and accompanying drawings.

BRIEF DESCRIPTION OF DRAWINGS

FIG. 21 is a schematic drawing illustrating a first embodiment of dynamic motor braking circuit constructed in accordance with the teachings of the present invention;

FIG. 22 is a transistor ON/OFF matrix diagram; and

FIG. 23 is a schematic drawing illustrating a second dynamic motor braking circuit embodiment.

MODES FOR CARRYING OUT THE INVENTION

Figure 1:
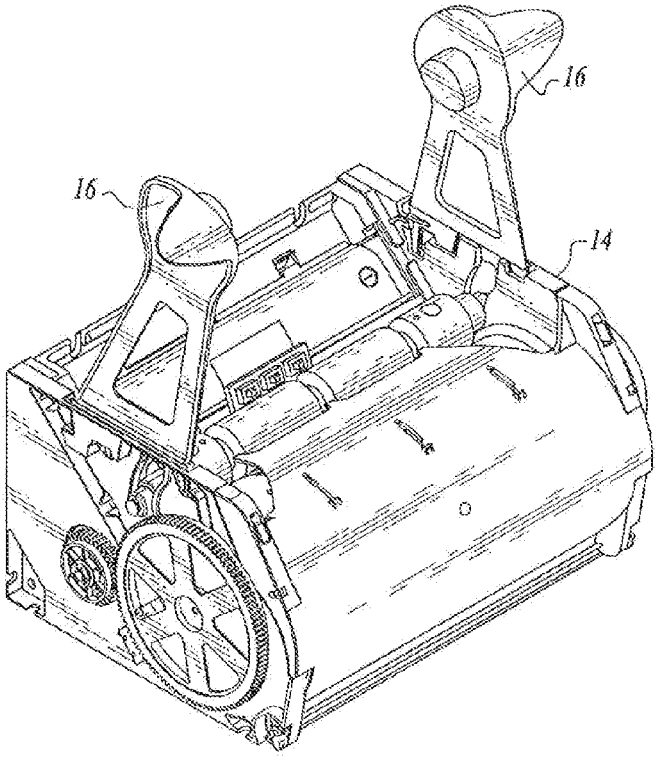
FIG. 1 is a front, perspective view illustrating internal components of a multi-function paper toweling dispenser.
Figure 2:
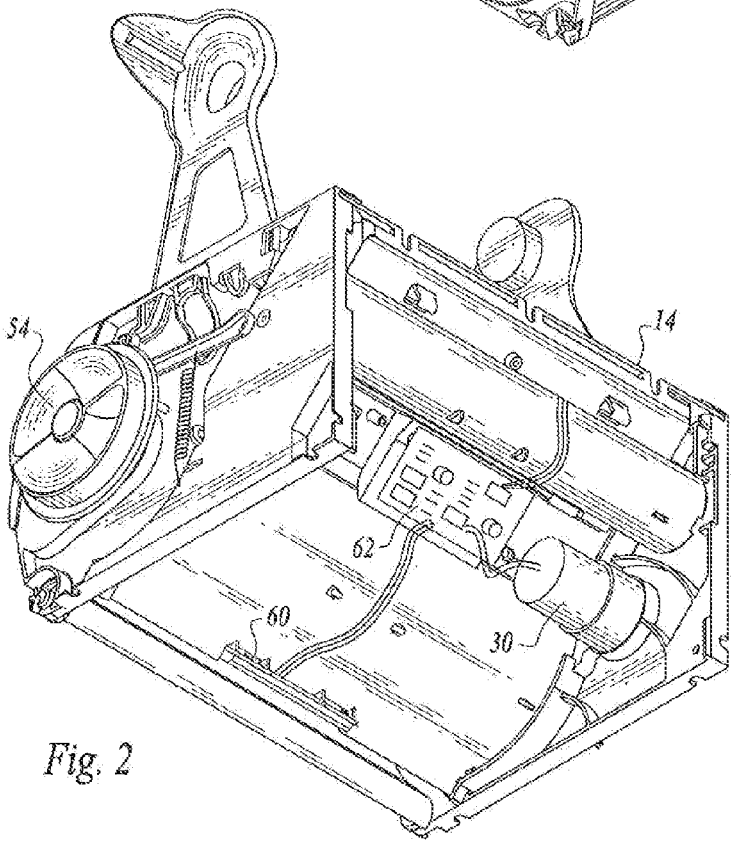
FIG. 2 is a back, perspective view of the components.
Figure 4:
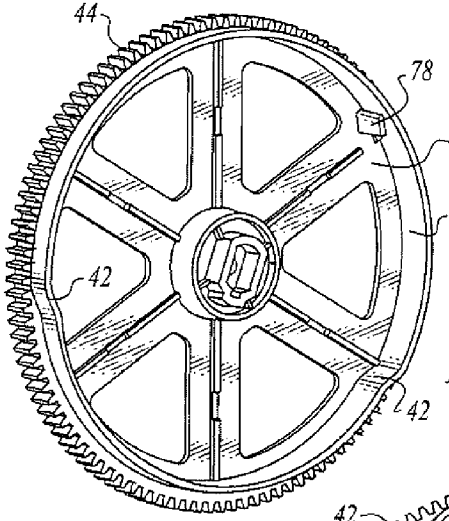
FIG. 4 is a perspective view illustrating a drive gear of the toweling support roller.
Figure 5:
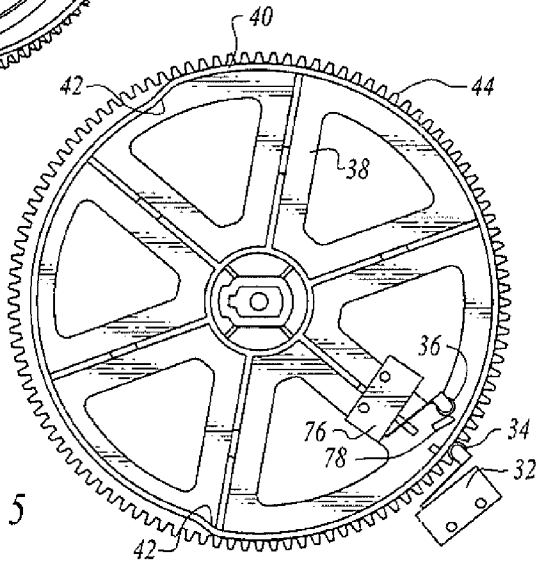
FIG. 5 is a side elevational view of the drive gear of the toweling support roller and illustrating mechanical electric switches employed therewith.
Figure 3:
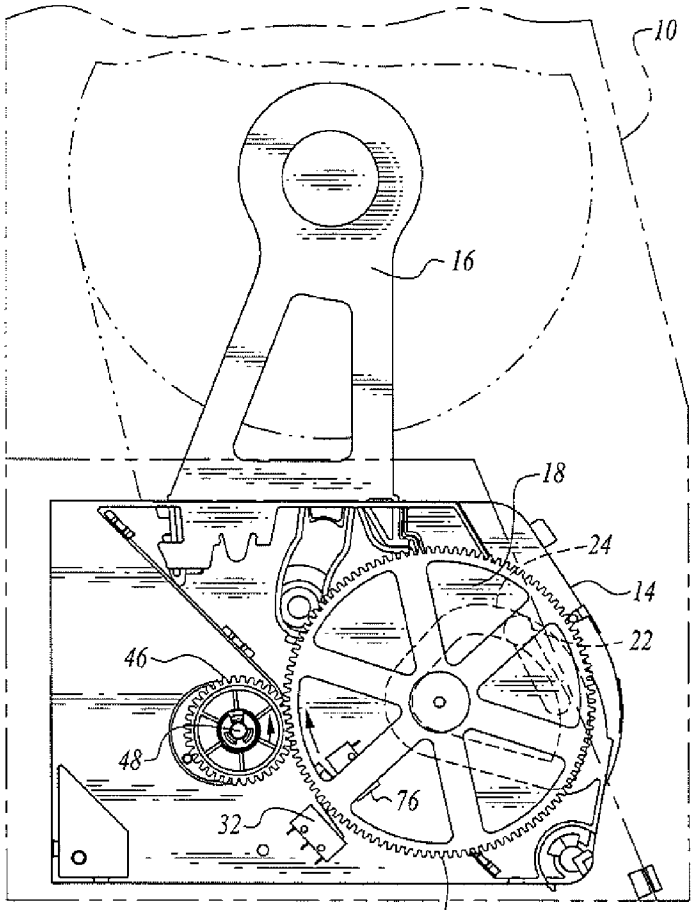
FIG. 3 is a side, elevational view showing the structure illustrated in FIG. 3 in solid lines, a housing and a supply roll of toweling being shown in phantom lines.

Referring now to the drawings, a multi-function paper towel dispenser constructed in accordance with the teachings of the present invention is illustrated. As explained and disclosed in greater detail below, the dispenser is selectively operable to dispense paper toweling from a roll of paper toweling employing a plurality of alternative operational mode, one of the modes being a "hybrid" mode wherein an electric motor assists user to reduce pull force or provide a tail.

FIGS. 1-20 are the same as the corresponding drawing figures in U.S. Pat. No. 8,382,026, referenced above.

FIGS. 21-23 hereof relate to structural components and operations carried out thereby of the present invention that are not disclosed in U.S. Pat. No. 8,382,026.

The paper towel dispenser disclosed in U.S. Pat. No. 8,382,026 and incorporated herein by reference includes a housing 10 (shown in FIGS. 3, 9-10, 13, 14, 17 and 19), the housing having a towel dispensing opening 12 at the bottom thereof.

Mounted in the interior of the housing 10 is an assembly 14 (see FIGS. 1-3) including operational structural components of the multi-function paper towel dispenser. These structural elements include a roll support in the form of spaced support arms 16 insertable into the open ends of a supply roll of paper toweling in a conventional fashion.

A rotatable toweling support roller 18 has a cylindrically-shaped outer peripheral surface and is rotatable in a predetermined direction of rotation. A cutter blade 20 (see FIG. 10) is mounted on the roller.

A cam follower 22 and cam system 24 (FIG. 3) are employed with the blade 20 and are suitably those disclosed in U.S. Pat. Nos. 6,314,850 and 6,553,879, the teachings of which are incorporated by reference into this application.

Rotation of toweling support roller 18 will cause the cam followers to move along the cam surfaces defining the channels. This, in turn, will cause the cutter blade 20 to pivot relative to the toweling support roller 18.

The cutter blade is movable between an inactive position wherein the cutter will not sever the toweling and a severing position wherein the cutter blade is positioned outwardly of the toweling support roller to at least partially sever the toweling on the toweling support roller.

An electric motor 30 is operatively associated with the toweling support roller for selectively rotating the toweling support roller. A mechanical electric switch 32 is operatively associated with the electric motor and with the toweling support roller. The electric switch is electrically connected to the electric motor through a microprocessor of circuit board 62.

The electric switch 32 is responsive to rotation of the toweling support roller 18 by a user of the dispenser from a rest or inactive position to a first position to energize the electric motor when the toweling support roller reaches the first position and cause rotation of the toweling support roller by the electric motor from the first position to a second position and reducing the pull force required by a user pulling the paper toweling during rotation of the toweling support roller between the first position and the second position. Further, the mechanical electrical switch 32 is responsive to rotation of the toweling support roller beyond the second position to deenergize the electric motor. This mode of operation, sometimes hereinafter referred by as a hybrid or third mode of operation, is described in more detail below.

Mechanical electric switch 32 includes a switch actuator element 34 having a roller 36 at the end thereof which is biased into engagement with a circular end 38 of the toweling support roller 18. The switch actuator element 32 alternatively opens or closes the switch during rotation of the toweling support roller.

Located at circular end 38 of the toweling support roller and engaged by the switch actuator element roller during rotation of the toweling support roller is an arcuate projection 40. The projection extends only part way along the periphery of the toweling support roller and has two tapered projection ends 42. Extending completely about circular end 38 and disposed outwardly of the arcuate projection is a toweling support roller gear 44 having teeth. Meshing with the teeth of the toweling support roller gear are teeth of a drive gear 46 which is driven by electric motor 30, the latter suitably being in the form of a DC gear motor. A one-way clutch needle bearing 48 connects the drive gear to the electric motor to allow the performance of certain functions indicated below. Electric wiring connects the switch 32 to the electric motor through a microprocessor.

Figure 6:
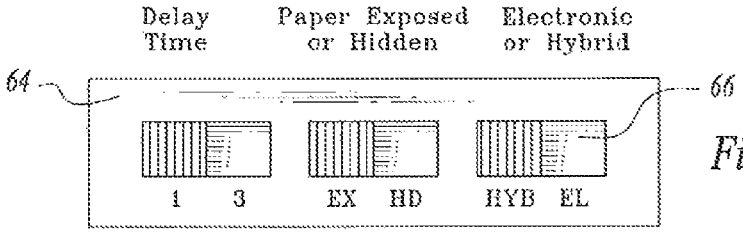
FIG. 6 is a plan view illustrating a switch panel having mode selection control switches and a time delay control switch.
Figure 7:
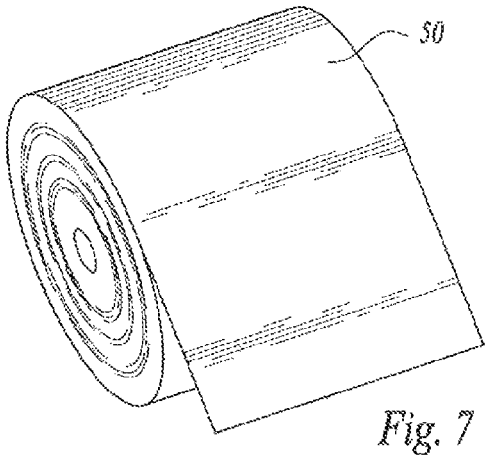
FIG. 7 is a perspective view of an unperforated supply roll of toweling that may be utilized in the multi-function paper towel dispenser.

FIGS. 6-10 may now be referred to in connection with operation of the multi-function paper towel dispenser in the third or hybrid mode. In such mode the roll of uncut or unperforated toweling 50 as shown in FIG. 7 would be used as the supply roll. FIG. 6 shows the setting of a control switch 66 to the hybrid setting, the hybrid mode of operation being but one of the mode of operation options, as will be explained in greater detail below.

Figure 8:
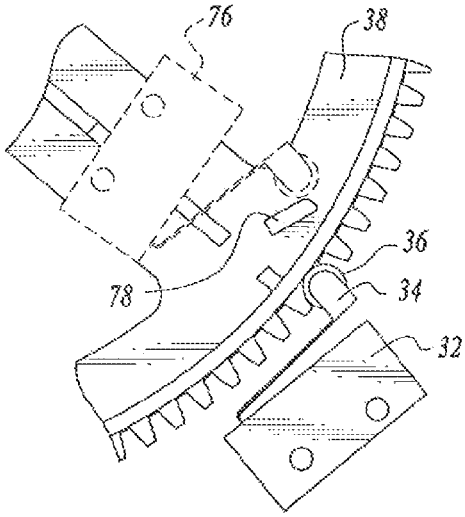
FIG. 8 is a greatly enlarged, side view illustrating a portion of the drive gear of the toweling support roller and its relationship with mechanical electric switches, one of which is shown in solid lines and the other in dash lines.
Figure 9:
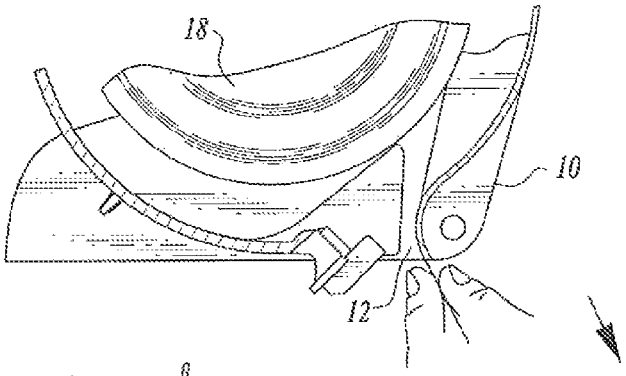
FIG. 9 shows a towel tail being grasped and dispensed when the control switches are in the position shown in FIG. 6.

FIG. 8 shows mechanical electric switch 32 being utilized in this mode of operation as indicated above. FIG. 9 shows a user manually grasping the tail of the toweling and pulling it to initiate rotation of the toweling support roller 18. Further pulling of the toweling energizes the electric motor to power rotation of the toweling support roller when the switch 32 is operated.

Figure 10:
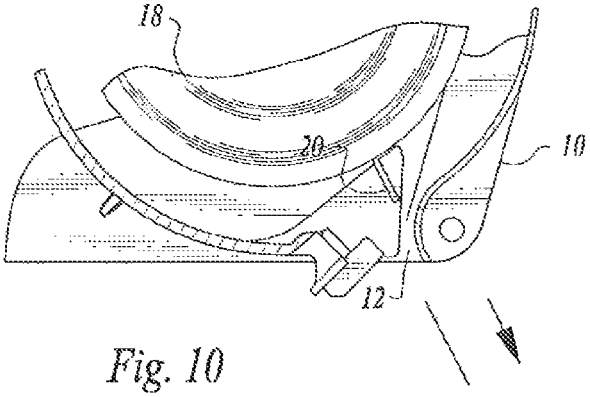
FIG. 10 illustrates the positioning of the toweling after a towel sheet has been removed by the user.

FIG. 10 illustrates a severed toweling section removed from the dispenser and a new tail moving into place to extend to a position under the housing where it can be manually grasped and pulled by the next user. The toweling tail may be brought to such position by manually rotating the toweling dispenser roller 18 by a rotatable manually engageable element in the form of a handle or knob 54 connected to the toweling support roller. A one-way clutch (not shown) may be employed to ensure that the toweling support roller is being rotated in a direction to advance toweling. The handle 54 can also be used to advance and dispense the toweling if the batteries fail. The user can pull on the tail as usual when not utilizing the apparatus without motor assistance. In this situation, the required pull force is still relatively low since the gear motor is in effect disengaged from the toweling support roller by employing a one-way clutch needle bearing or some other one-way clutch mechanism.

The multi-function paper towel dispenser incorporates sensor structure operatively associated with the electric motor to energize the electric motor and cause rotation of the toweling support roller to transport the paper toweling for dispensing. This sensor structure is utilized in conjunction with electronic control circuitry in a manner which will now be described.

The sensor structure is identified by reference numeral 60 and employs a "bouncing" technology in the infrared spectrum that bounces a wave off a hand or paper to activate the unit. That is, the sensor structure is operatively associated with the electric motor to energize the electric motor and cause rotation of the toweling support roller to transport the paper toweling for dispensing from the multi-function paper toweling dispenser in either first mode of operation wherein the electric motor is energized responsive to the sensor structure sensing positioning of a user's hand or other object at a predetermined location external of the housing or in a second mode of operation wherein the electric motor is energized responsive to the sensor structure sensing the removal of a toweling tail from a location external of the housing.

The control switch panel 64 and control switches shown in FIGS. 6, 11, 16, and 18 are associated with an electronic circuit board and utilized to select the various modes in which the multi-function paper towel dispenser can operate. Switch 66 is employed to switch between the hybrid mode of operation described above and an electronic mode of operation wherein the sensor structure 60 and control circuitry are utilized to operate the dispenser in either a paper hidden mode (hereinafter sometimes referred to as the first mode) of operation or a paper exposed mode (sometimes hereinafter referred to as the second mode of operation). Switch 68 of the switch display selects either the paper hidden mode or the paper exposed mode. A third switch 70 is utilized to set and adjust the time delay between cycles, for example approximately one second or approximately three seconds. When the switch 66 is set to hybrid operation, the switch 68 for exposed paper or hidden paper operation is inactive.

Figure 11:
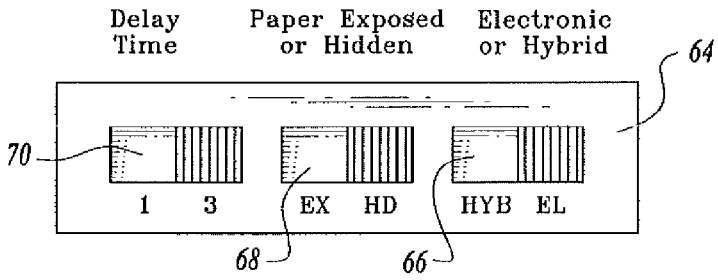
FIG. 11 is a view similar to FIG. 6, but illustrating the condition of the control switches during a different mode of operation.
Figure 13:
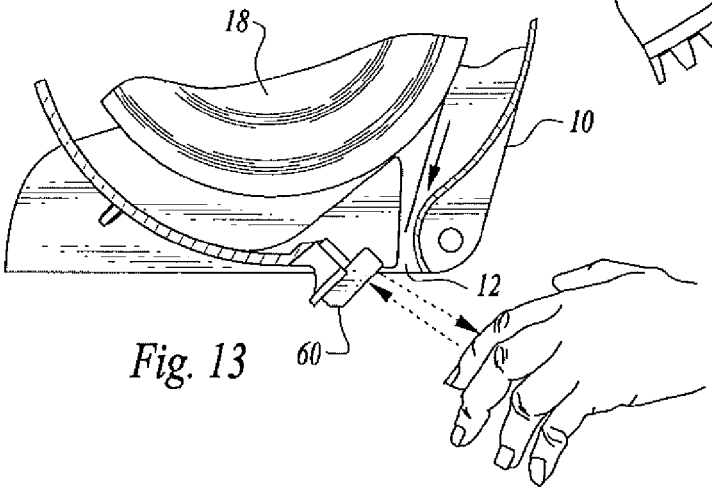
FIG. 13 is a view similar to FIG. 9, but illustrating initial dispensing of a towel in response to a sensed user's hand.
Figure 15:
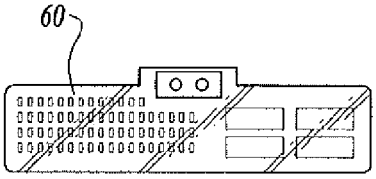
FIG. 15 is a plan view illustrating sensor structure of the multi-function paper towel dispenser.

FIG. 11 illustrates switch 66 set for electronic control and switch 68 set for the paper hidden or first mode of operation wherein the electric motor is energized responsive to the sensor structure sensing positioning of a user's hand at a predetermined location external of the housing. FIG. 13 illustrates a user's hand positioned where it can be sensed and the infrared wave transmitted by sensor structure 60 being bounced off the hand to the sensor structure receiver. This results in the control circuitry on circuit board 62 energizing the electric motor and causing rotation of the toweling support roller to move the towel tail in a downward direction as illustrated by the arrow and available for grasping and removal by the user.

A second mechanical electric switch 76 is employed when the multi-function paper towel dispenser operates in either the paper hidden mode or paper exposed mode to stop rotation of the toweling support roller when the dispensing cycle is completed. Switch 76 is fixedly mounted adjacent to toweling support roller gear 44 and is engageable during rotation of the toweling support roller by a projection 78 extending from the gear 44. Once the first and second mode mechanical electrical switch 76 is engaged by the projection 78, rotation of the toweling support roller and transport of the toweling will come to a stop.

Switches 32 and 76 may be incorporated in a manually operated knob such as that disclosed in co-pending U.S. patent application Ser. No. 13/317,492, filed Oct. 19, 2011.

During rotation of the toweling support roller the blade associated with the toweling support roller will cut the sheet, the amount of which is controlled by the position of the actuator of mechanical electric switch 76. In a preferred actuator position, the sheet is cut more than ninety percent. This allows the user to easily remove the sheet with a very light pull force. When the sheet is removed by the user, the dispenser will not dispense another sheet until the user puts a hand under the sensor.

Figure 12:
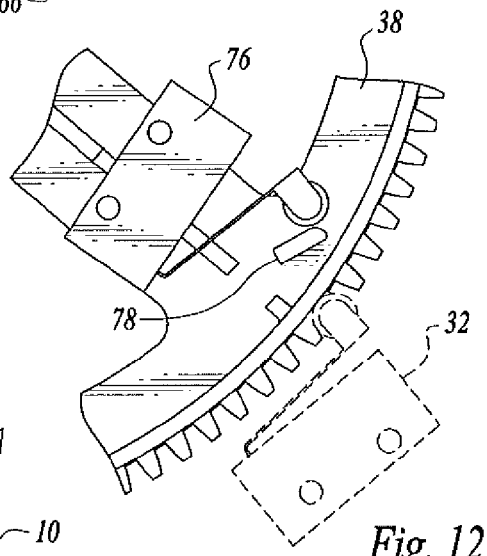
FIG. 12 is a view similar to FIG. 8, but illustrating the condition of the toweling support roller and the mechanical electric switches associated therewith in a different mode of operation as determined by the control switches in FIG. 11 wherein the electric motor is energized responsive to sensor structure sensing positioning of a user's hand.
Figure 14:
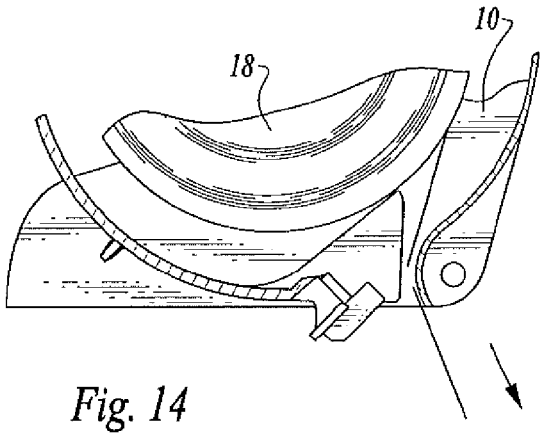
FIG. 14 illustrates a towel removed from the rest of the toweling at the end of the dispensing cycle illustrated.

FIGS. 11, 12 and 14 illustrate operation in the first or paper hidden mode.

Figure 16:
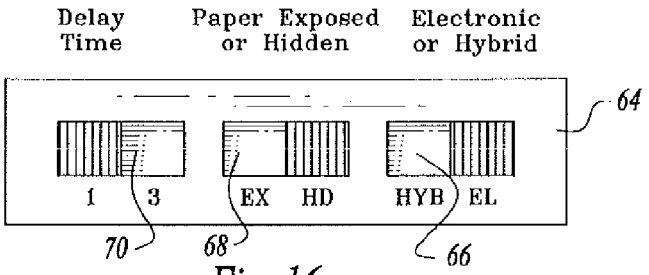
FIG. 16 is a view similar to FIGS. 6 and 11, but illustrating different control switch positions.

FIG. 16 shows the control switch panel with the control switches 66 and 68 in the same positions as shown in FIG. 11, but with switch 70 changed to a position which sets the delay time between cycles to approximately one second as compared to three seconds in FIG. 11.

Figure 17:
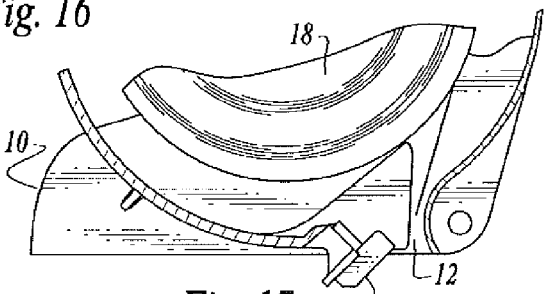
FIG. 17 shows the condition of a toweling tail when hidden as selected by the middle control switch in FIG. 16.

FIG. 17 is a view similar to FIG. 13, but with the paper towel dispenser inactive and with the tail in a hidden position, that is in a position where the tail is essentially non-visible from outside the housing. Again, reactuation will only take place if a hand or other object is in a position relative to the housing and sensor 60 that would initiate the next cycle, which can occur after approximately a second has passed.

Figure 18:
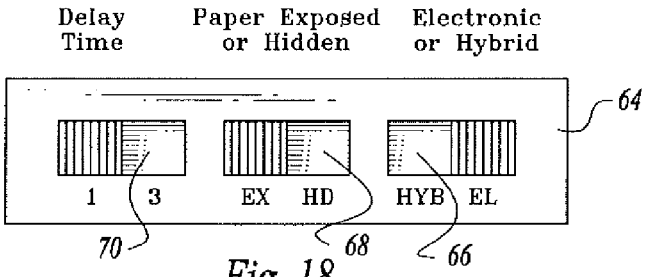
FIG. 18 illustrates the middle switch moved to a position that results in the tail being exposed.
Figure 19:
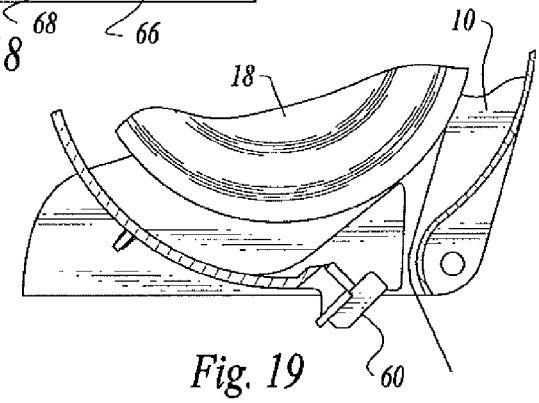
FIG. 19 shows the toweling tail exposed and extending from the bottom of the dispenser housing.
Figure 20:
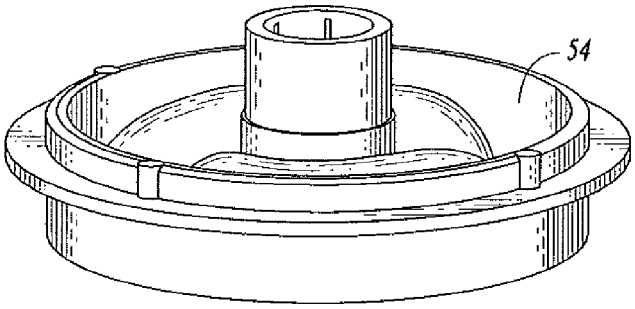
FIG. 20 is a perspective view of a manually graspable turning knob or handle employed to rotate the toweling support roller.

FIG. 18 shows the switch 66 in the electronic control position and switch 68 selecting the paper exposed or second mode of operation wherein the electric motor is energized responsive to the sensor sensing the removal of a toweling tail from a location external of the housing. In this mode the sensor is looking for the presence of a paper tail. As long as the paper tail is covering the sensor's range, the motor remains deenergized. When a user removes the hanging sheet, the lack of paper in front of the sensor will trigger the motor to turn on. The motor turns the toweling support roller until mechanical electric switch 76 is triggered by the projection 78 on the toweling support roller gear 44. Rotation of the toweling support roller will have advanced and cut the sheet, the amount of which is controlled by the switch actuator position of mechanical electric switch 76. In this mode of operation, the multi-function paper towel dispenser always has a long tail of paper hanging downwardly from the housing, for example 9 inches. In a preferred embodiment, the sheet is pre-cut more than ninety percent. This allows the user to easily remove the sheet with a very light pull force.

FIGS. 21-23 show modifications made to the above-described structure in accordance with the teachings of the present invention. There are two embodiments of the modifications, one embodiment depicted in FIGS. 21 and 22, and a second embodiment depicted in FIG. 23. Both embodiments are dynamic braking structures for electrically braking the DC motor 30 (FIG. 2) disclosed in U.S. Pat. No. 8,382,026. The dynamic braking structures of FIG. 21 and FIGS. 22-23 are operatively connected to the control circuitry on circuit board 62 (FIG. 2) which energizes and deenergizes the DC motor 30. Tail sensor structure such as that disclosed in co-pending U.S. patent application Ser. No. 14/249,434, filed Apr. 10, 2014, may be utilized.

FIG. 23 shows a dispenser brake structure including a circuit utilizing a mechanical relay 104. The DC motor 30 is off as depicted in FIG. 23. The circuit is employed with the above-described control circuit on circuit board 62 so that when the control circuit receives a signal to power DC motor 30 it powers relay 104 which in turn switches the DC motor on (NO position shown in FIG. 23). The relay remains powered during the entire time the motor is on.

When the control circuit receives a signal to turn off the motor it removes power at the relay. This removes the power to the motor and connects the motor terminals together (NC position).

When powered, the windings/coils of the DC motor 30 store electro-magnetic energy by means of an electrical field. When the power to the motor is disconnected this energy field collapses and supplies electrical energy that further sustains the motor rotation. With dynamic braking, as this field collapses this electro-magnetic energy is applied back to the motor by using the relay 104 (or H-Bridge as shown in FIGS. 21 and 22 and described below) that effectively shorts the motor terminals, momentarily reversing the current direction. The reversed current direction tries to rotate the motor opposite its driving direction, quickly stopping the motor.

A diode 102 is employed in the circuit to protect the circuit from reverse EMF (Electro Motive Force) developed at the motor. That is, EMF refers to the voltage generated by a spinning motor. Reference numeral 106 depicts Magnetic Field at the motor.

Every time the DC motor 30 turns off it brakes, regardless of the dispensing mode. The DC motor 30 is operatively associated with the sheet material support roller of the dispenser for rotating the sheet material support roller and moving the tail portion relative to the housing exit opening to a preselected position with the leading end thereof either within the housing interior or externally of the housing, depending upon which dispensing operation employing a DC motor is being carried out.

FIGS. 21 and 22 relate to an embodiment wherein an H-Bridge 110 rather than a mechanical relay is employed. H-Bridge 110 is a solid state device that performs a function comparable to that of a mechanical relay, but electronically with transistors A, B, C and D.

Use of an H-Bridge is preferred because it consumes less electricity than a mechanical relay and costs less.

The invention claimed is:

1. Paper sheet material dispenser apparatus for dispensing paper sheet material from a roll of paper sheet material having an existing tail portion with a leading end, said dispenser apparatus comprising, in combination:

a housing having a housing interior and defining an opening communicating with said housing interior;

a roll support within said housing interior for rotatably supporting the roll of paper sheet material;

a rotatable sheet material support roller for receiving paper sheet material from the roll of paper sheet material, said sheet material support roller having a cylindrically-shaped outer peripheral surface;

a DC motor for receiving DC power from a DC power source, said DC motor having a rotatable motor shaft connected to said sheet material support roller by a one way clutch structure for exerting a driving force on said sheet material support roller rotating said sheet material support roller in a rotational direction advancing said paper sheet material and moving the tail portion relative to said opening toward a position with the leading end thereof disposed either within said housing interior or externally of said housing, said one way clutch structure allowing continued rotation of the support roller in said rotational direction after rotation of the motor shaft has stopped; and a dynamic braking structure operatively associated with said DC motor responsive to termination of DC power from the DC power source to the DC motor to electrically brake said DC motor by reversing the direction of DC current applied to said DC motor and place the tail portion at said position.

2. The paper sheet material dispenser apparatus according to claim 1 wherein said reversed DC current is from electromagnetic energy remaining in the DC motor during energy field collapse after termination of DC current from the DC power source to said DC motor.

3. The paper sheet material dispenser apparatus according to claim 1 wherein said dynamic braking structure includes an H-bridge effectively shorting motor terminals of said DC motor, reversing the DC current.

4. The paper sheet material dispenser apparatus according to claim 1 wherein said dynamic braking structure includes a relay effectively shorting motor terminals of said DC motor, reversing the DC current.

5. The paper sheet material dispenser apparatus according to claim 1 wherein said one way clutch structure is a one way clutch bearing.

* * * * *